United States Patent [19]

Dyson

[11] 4,118,870

[45] Oct. 10, 1978

[54] EYEBROW CONTOUR GUIDE

[75] Inventor: Evelyna Chelsey Dyson, Tenafly, N.J.

[73] Assignee: Revlon, Inc., New York, N.Y.

[21] Appl. No.: 810,066

[22] Filed: Jun. 27, 1977

[51] Int. Cl.[2] ..... G01B 3/14

[52] U.S. Cl. ..... 33/174 D

[58] Field of Search ..... 33/174 D, 174 B, 174 G

[56] References Cited

U.S. PATENT DOCUMENTS

| | | | |
|---|---|---|---|
| 1,211,793 | 1/1917 | Von Horvath | 33/174 B |
| 1,566,661 | 12/1925 | Essig | 33/174 D |
| 3,300,864 | 1/1967 | Lesslie | 33/174 D |

*Primary Examiner*—Richard E. Aegerter
*Attorney, Agent, or Firm*—Leon E. Tenenbaum

[57] ABSTRACT

An eyebrow contour guide comprising a scaled alignment member which is placed on the nose, a movable scaled arcuate member having therein an arcuate slot, which is placed over the eyebrow, one end of said arcuate member being pivotally secured to the top end of the alignment member, a sliding member adapted for movement along the length of the alignment member, and a movable pointer, one end of which is attached to the sliding member and whose other end moves arcuately on the scale of the arcuate member.

3 Claims, 5 Drawing Figures

LEFT EYE
NOSE LEVEL
10
9
8
7
6
5
4
3
2
1
10
9
8
7
6
5
4
3
2
1
10
9
8
7
6
5
4
3
2
1

EYEBROW CONTOUR GUIDE

This invention relates to cosmetic devices, and more particularly to guides for shaping the eyebrows.

There are a number of devices available to the beautician for aid in shaping the eyebrows. These include stencils, patches and embossed printing devices. The devices now available are not easy to align and frequently are awkward to use. In the case of patches, removal causes discomfort. Because of difficulty in alignment, the shaping is rarely the same for both eyebrows resulting in a misshapen appearance. There are devices available which combine stencils provided with handles or guides for engaging some other part of the face, frequently the nose, but these devices do not provide for differences in the shapes of the face and nose.

It is, accordingly, an object of the present invention to provide guides for shaping the eyebrows (eyebrow contour guides) which will provide substantially the same shape to each eyebrow.

It is another object of the present invention to provide an eyebrow contour guide which is easy to align on the face of the user, and can be used for all types of faces regardless of their shapes.

Other objects and structural and functional features will be apparent from the following detailed description taken in conjunction with the accompanying drawings.

In accordance with the present invention there is provided an eyebrow contour guide comprising a scaled alignment member which is placed on the nose, a movable scaled arcuate member having therein an arcuate slot, which is placed over the eyebrow, one end of said arcuate member being pivotally secured to the top end of the alignment member, a sliding member adapted for movement along the length of the alignment member, and a movable pointer one end of which is pivotally attached to the sliding member and the other end moves arcuately on the scale of the arcuate member.

BRIEF DESCRIPTION OF THE DRAWINGS

FIG. 2 is a front elevational view thereof in the position for being placed over the left eyebrow;

Figure 1:
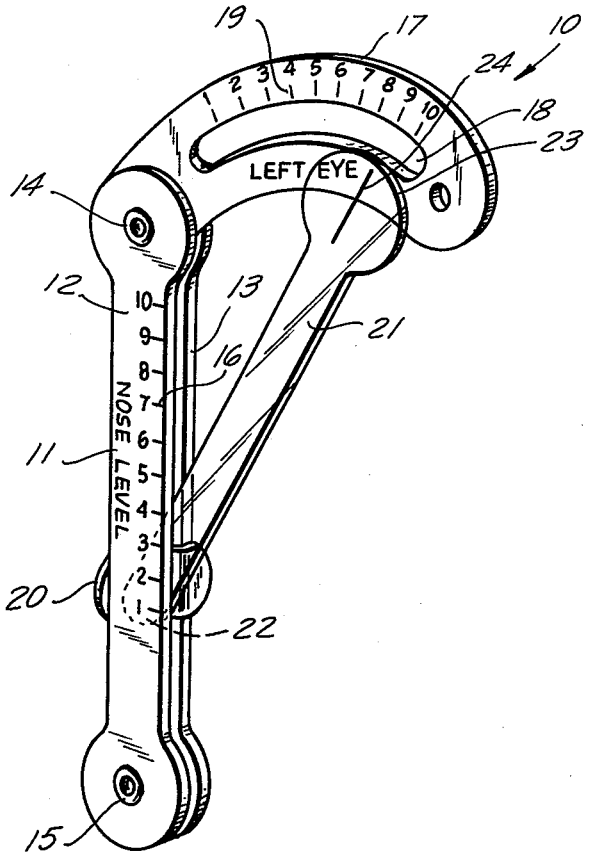
FIG. 1 is a perspective view of an eyebrow contour guide of the present invention.
Figure 3:
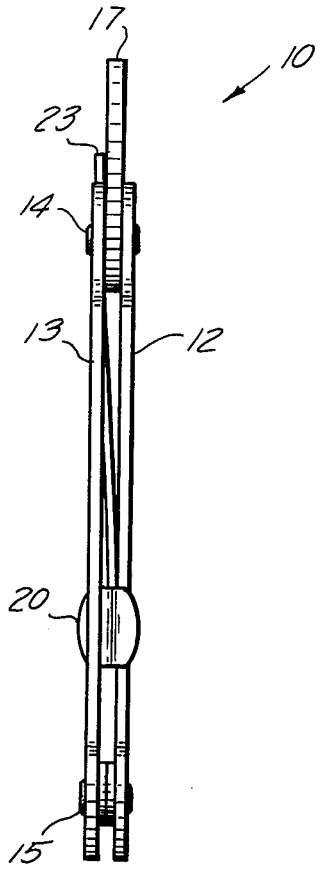
FIG. 3 is an edge elevational view of the outer side thereof.
Figure 5:
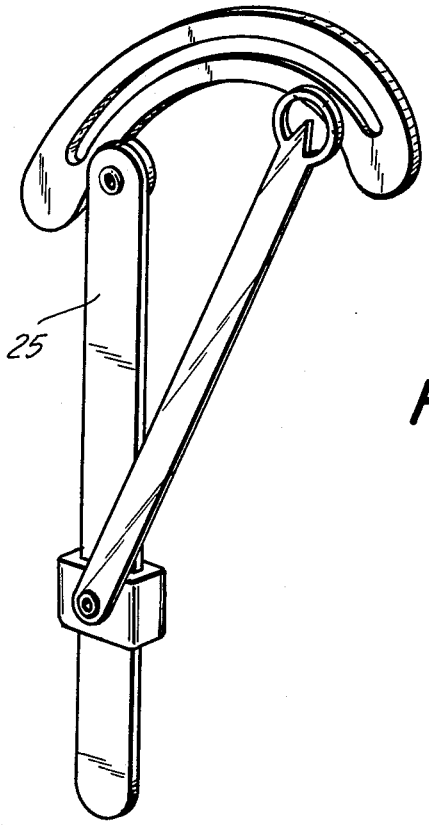
FIG. 5 is a perspective view of another eyebrow contour guide according to the present invention.
Figure 4:
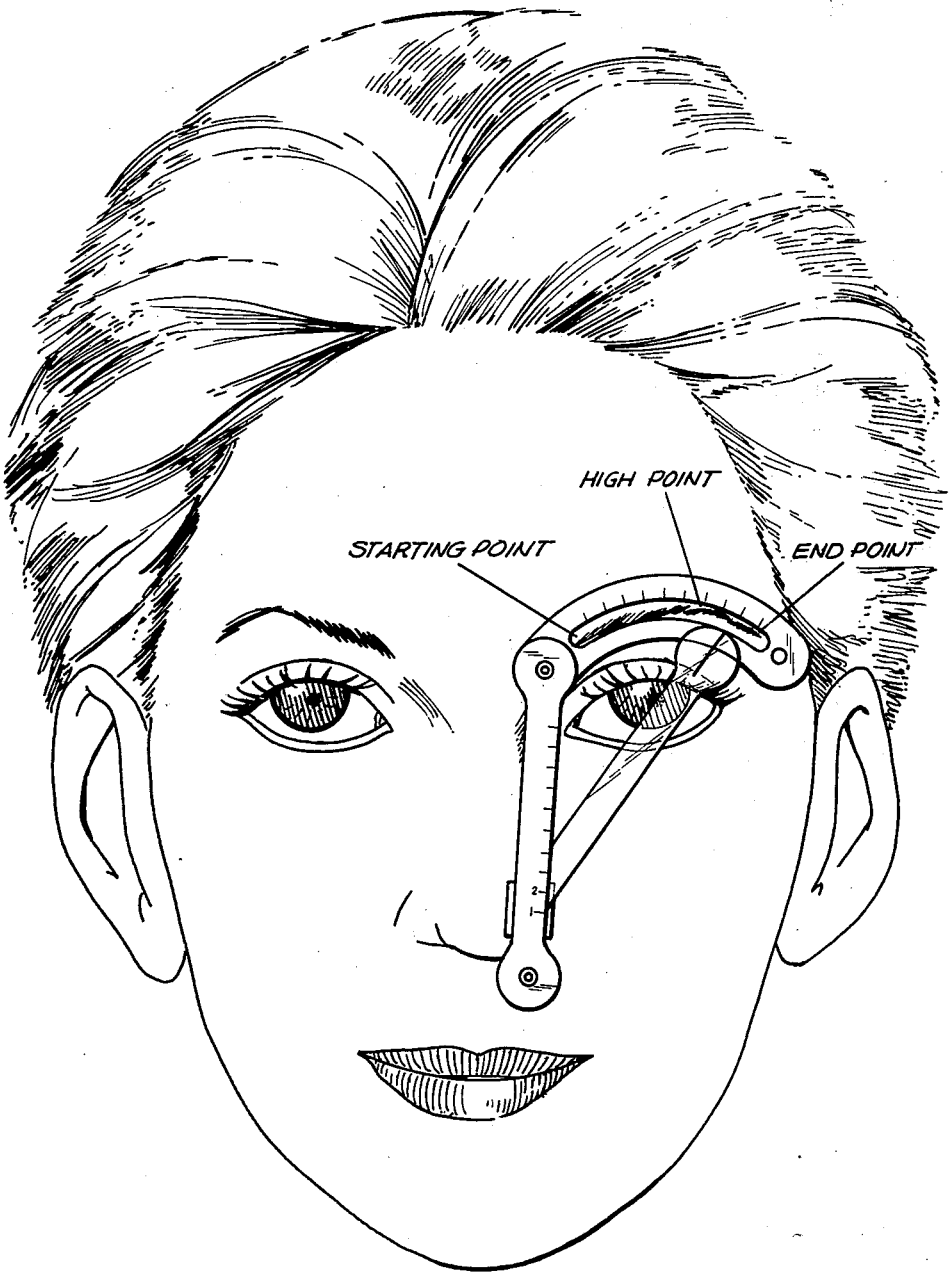
FIG. 4 is a view showing a full face view of a person using the eyebrow contour guide on the left eyebrow.

Referring to the drawings which illustrate preferred embodiments of the invention, reference number 10 generally indicates the eyebrow contour guide. The guide comprises an alignment member 11 for placing on the nose. The alignment member is preferably composed of 2 spaced, substantially parallel opposing sections 12 and 13 of exactly the same shape, which are secured to each other at their ends by means of hollow rivents 14 and 15. The outer portion of each section is provided with a scale 16. The alignment member may be constructed of a single section 25 as shown in FIG. 5. Pivotally secured to the top end of the alignment member on the rivet is an arcuate member 17 which is placed over the eyebrow. The arcuate member is provided with an arcuate slot 18 along substantially most of its length and a scale 19. A sliding member 20 is placed between the spaced parallel opposing sections of the alignment member, to which a movable pointer 21 is pivotally secured at one of its ends 22, and whose other end 23 moves arcuately along the scale of the arcuate member. Preferably, for ease in viewing, the pointer is composed of transparent material such as lucite, and is provided with an indicator line 24.

The device may be constructed of any lightweight, substantially rigid material which is non-toxic and non-irritating. Preferably, a plastic material is used.

In using the eyebrow contour guide of the present invention the arch of the arcuate shaped member is laid against the user's brow line. The alignment member is then aligned with the user's nose. The calibration of the setting for the user is then determined by sliding the movable member into alignment with the nostril of the user. The movable pointer is then moved to the number on the alignment member over the highest point of the arch of the eyebrow. The arcuate member is then moved so that the slot is placed over the eyebrow and marks are made over 3 points, the point closest to the nose, the high point as determined above, and the point furthest from the nose. This will exactly determine the perfect shape and length of the user's eyebrow. To duplicate the eyebrow shape on the other side, the guide is reversed and the same calibrated numbers previously determined are used.

I claim:

1. An eyebrow contour guide comprising a scaled alignment member which is placed on the nose, a movable scaled arcuate member having therein an arcuate slot, which is placed over the eyebrow, one end of said arcuate member being pivotally secured to the top end of the alignment member, a sliding member adapted for movement along the length of the alignment member, and a movable pointer one end of which is pivotally attached to the sliding member and whose other end moves arcuately on the scale of the arcuate member.

2. An eyebrow contour guide according to claim 1, wherein the alignment member comprises two spaced, substantially parallel opposing sections of the same shape which are secured to each other at their ends.

3. An eyebrow contour guide according to claim 1, wherein the end of the pointer moving along the scale of the arcuate member is provided with an indicator line.

* * * * *